US005828342A

United States Patent [19]

Hayes et al.

[11] Patent Number: 5,828,342

[45] Date of Patent: Oct. 27, 1998

[54] MULTIPLE BAND PRINTED MONOPOLE ANTENNA

[75] Inventors: Gerard James Hayes, Wake Forest; Ross Warren Lampe, Raleigh, both of N.C.

[73] Assignee: Ericsson Inc., Research Triangle Park, N.C.

[21] Appl. No.: 859,938

[22] Filed: May 22, 1997

Related U.S. Application Data

[63] Continuation of Ser. No. 459,235, Jun. 2, 1995, abandoned.

[51] Int. Cl.[6] ..... H01Q 1/24

[52] U.S. Cl. ..... 343/702; 343/833

[58] Field of Search ..... 343/700 MS, 702, 343/873, 749, 895, 720, 833, 835, 818

[56] References Cited

U.S. PATENT DOCUMENTS

| | | | |
|---|---|---|---|
| 3,231,894 | 1/1966 | Nagai | 343/806 |
| 3,585,536 | 6/1971 | Braginski | 333/31 |
| 4,138,681 | 2/1979 | Davidson et al. | 343/702 |
| 4,356,492 | 10/1982 | Kaloi | 343/700 |
| 4,370,657 | 1/1983 | Kaloi | 343/700 |
| 4,381,566 | 4/1983 | Kane | 455/193 |
| 4,459,593 | 7/1984 | Hall et al. | 343/700 |
| 4,475,107 | 10/1984 | Makimoto et al. | 343/700 |
| 4,644,366 | 2/1987 | Scholz | 343/895 |
| 4,725,395 | 2/1988 | Gasparaitis et al. | 264/250 |
| 4,800,392 | 1/1989 | Garay et al. | 343/700 |

(List continued on next page.)

FOREIGN PATENT DOCUMENTS

| | | | |
|---|---|---|---|
| 590534A | 9/1993 | European Pat. Off. | H01Q 1/24 |
| 0590534 | 4/1994 | European Pat. Off. | H01Q 1/24 |
| 0616383 | 1/1995 | European Pat. Off. | H01Q 1/27 |
| 0642189 | 3/1995 | European Pat. Off. | H01Q 1/24 |
| 4324480 | 1/1995 | Germany | H01Q 9/30 |
| 9105374 | 4/1991 | WIPO | H01Q 9/40 |
| 9428595 | 12/1994 | WIPO | H01Q 19/09 |

OTHER PUBLICATIONS

Electronics Letter vol. 30 n.21, dated Oct. 13, 1994, Stevenage pp. 1725–1726, XP002011407 Lebbar et al, "*Analysis and Size Reduction of Various Printed Monopoles with Different Shapes*".

Timothy L. Higby & Donald Beaumont, "*High Frequency Whip Antenna (800 MHz)*", Motorola Developments, vol. 6, Oct. 1986, p. 24.

Patent Abstracts of Japan, vol. 14 No. 308, Yutaka, et al. Jul. 1990. JP 2098202.

IEEE Transactions on Antennas and Propagation, vol. AP–32, No. 4, XP002011484, Nakano et al. "*Shortening Ratios of Modified Dipole Antennas*", Apr. 1984, pp. 385–386.

(List continued on next page.)

*Primary Examiner*—Don Wong
*Assistant Examiner*—Tan Ho
*Attorney, Agent, or Firm*—James P. Davidson

[57] ABSTRACT

A printed monopole antenna is disclosed including a first printed circuit board having a first side and a second side, a first monopole radiating element in the form of a conductive trace formed on a side of the first printed circuit board, and a second monopole radiating element in the form of a conductive trace positioned adjacent the first monopole radiating element, wherein the first monopole radiating element is resonant within a first frequency band and the second monopole radiating element is resonant within a second frequency band. In order for the first and second radiating elements to be resonant within different frequency bands, the conductive traces for each have different electrical lengths. No direct electrical connection exists between the monopole radiating elements, but the second radiating element dominates at a frequency in which the second radiating element is approximately a half-wavelength so that coupling with the first radiating element occurs. The first and second monopole radiating elements are formed on the same side of the first printed circuit board, separate sides of the first printed circuit board, or on separate printed circuit boards.

42 Claims, 2 Drawing Sheets

U.S. PATENT DOCUMENTS

| | | | |
|---|---|---|---|
| 4,849,765 | 7/1989 | Marko | 343/834 |
| 4,860,020 | 8/1989 | Wong et al. | 343/834 |
| 5,008,681 | 4/1991 | Cavallara et al. | 343/700 |
| 5,075,691 | 12/1991 | Garay et al. | 343/830 |
| 5,124,733 | 6/1992 | Haneishi | 343/700 |
| 5,231,412 | 7/1993 | Eberhardt et al. | 343/790 |
| 5,262,791 | 11/1993 | Tsuda et al. | 343/700 |
| 5,270,722 | 12/1993 | Delestre | 343/700 |
| 5,313,216 | 5/1994 | Wang | 343/700 |
| 5,363,114 | 11/1994 | Shoemaker | 343/713 |
| 5,382,959 | 1/1995 | Pett et al. | 343/700 |
| 5,389,937 | 2/1995 | Kaloi | 343/700 |
| 5,406,295 | 4/1995 | Baranski et al. | 343/713 |
| 5,463,406 | 10/1995 | Vannatta et al. | 343/702 |
| 5,489,914 | 2/1996 | Breed | 343/818 |

OTHER PUBLICATIONS

Bahl, I.J., "Microstrip Antennas," pp. 1–7 and 214–220 (1980).

Conference Proceedings RF Expo West 1995 EMC/ESD International, dated Jan. 29, 1995–Feb. 1, 1995, San Diego, CA, pp. 117–124, X000492813 Breed, "*Multi–Frequency Antennas for Wireless Applications*".

U.S. Patent Application SN 08/460,578, "*Method of Manufacturing a Printed Antenna*" by Gerard Hayes et al. filed Jun. 2, 1995.

U.S. Patent Application SN 08/459,959 "*Printed Antenna Having Electrical Length Greater Than Physical Length*" by Gerard Hayes et al., filed Jun. 2, 1995 (Now abandoned).

U.S. Patent Application SN 08/459,553 "*Multiple Band Printed Monopole Antenna*" by Gerard Hayes et al. filed Jun. 2, 1995.

U.S. Patent Application SN 08/459,237 "*Printed Monopole Antenna*" by Gerard Hayes, et al. filed Jun. 2, 1995.

XP00492813, Gary A. Breed, "Multi–Frequency Antennas for Wireless Applications" Conference Proceedings Re Expo West 1995 EMC/ESD, Jan. 29, 1995.

MULTIPLE BAND PRINTED MONOPOLE ANTENNA

This application is a continuation of application Ser. No. 08/459,235, filed Jun. 2, 1995, now abandoned.

BACKGROUND OF THE INVENTION

1. Field of the Invention

The present invention relates to monopole antennas for radiating electromagnetic signals and, more particularly, to a printed monopole antenna including a plurality of radiating elements of different electrical lengths formed adjacent to each other so the monopole antenna is resonant within a plurality of frequency bands.

2. Description of Related Art

It has been found that a monopole antenna mounted perpendicularly to a conducting surface provides an antenna having good radiation characteristics, desirable drive point impedance, and relatively simple construction. As a consequence, monopole antennas have been utilized with portable radios, cellular telephones, and other personal communication systems. To date, however, such monopole antennas have generally been limited to wire designs (e.g., the helical configuration in U.S. Pat. No. 5,231,412 to Eberhardt et al.), which operate at a single frequency within an associated bandwidth.

In order to minimize size requirements and permit multi-band operation, microstrip and lamina antennas have been developed for use with certain communication applications. More specifically, U.S. Pat. No. 4,356,492 to Kaloi discloses a microstrip antenna system including separate microstrip radiating elements which operate at different and widely separated frequencies while being fed from a single common input point. However, these radiating elements are directly connected with each other and require a ground plane which fully covers the opposite side of a dielectric substrate from such radiating elements. Clearly, this design is impractical for monopole antenna applications, and indeed functions in a completely different manner. Likewise, the lamina antennas disclosed by U.S. Pat. Nos. 5,075,691 and 4,800,392 to Garay et al. require both a direct connection between radiating elements and a ground plane in order to provide multi-band operation.

Further, U.S. Pat. No. 5,363,114 to Shoemaker discloses a planar serpentine antenna which includes a generally flat, non-conductive carrier layer and a generally flat radiator of a preselected length arranged in a generally serpentine pattern secured to the surface of the carrier layer. One form of this antenna has a sinuous pattern with radiator sections in parallel spaced relation in order to provide dual frequency band operation. However, it is seen that the two frequencies at which resonance takes place involves the length of each radiator section and the total length between first and second ends. While this arrangement is suitable for its intended purpose, it likewise is incapable of operating in the fashion of a monopole antenna.

Accordingly, it would be desirable for a monopole antenna to be developed which not only is operable within more than one frequency band, but also avoids the associated limitations of microstrip and lamina antennas. Further, it would be desirable for a printed monopole antenna to be developed which operates within more than one frequency band and is configured to permit spacing of radiating elements within a single plane.

In light of the foregoing, a primary object of the present invention is to provide a monopole antenna which is operable within more than one frequency band.

Another object of the present invention is to provide a monopole antenna which can be constructed within very tight tolerances.

Still another object of the present invention is to provide a printed monopole antenna operable within more than one frequency band.

Yet another object of the present invention is to provide a printed monopole antenna which operates as a half-wavelength antenna within a first frequency band and as a quarter-wavelength or half-wavelength antenna within a second frequency band.

Another object of the present invention is to provide a monopole antenna which eliminates ground plane requirements found in microstrip and lamina antennas.

Still another object of the present invention is to eliminate direct electric connection between radiating elements of a multi-band antenna.

A further object of the present invention is to provide a printed monopole antenna which can be easily configured for operation at a variety of frequency bands.

These objects and other features of the present invention will become more readily apparent upon reference to the following description when taken in conjunction with the following drawing.

SUMMARY OF THE INVENTION

In accordance with one aspect of the present invention, a printed monopole antenna is disclosed including a first printed circuit board having a first side and a second side, a first monopole radiating element in the form of a conductive trace formed on a side of the first printed circuit board, and a second monopole radiating element in the form of a conductive trace positioned adjacent the first monopole radiating element. The first monopole radiating element has an electrical length which is resonant within a first frequency band and the second monopole radiating element has an electrical length which is resonant within a second frequency band. In order for the first and second monopole radiating elements to be resonant within different frequency bands, the conductive traces for each have different electrical lengths. No direct electrical connection exists between the monopole radiating elements, but the second radiating element dominates at a frequency in which the second radiating element is approximately a half-wavelength so that coupling with the first radiating element occurs. This particular configuration involves the first and second monopole radiating elements being formed on the same side of the first printed circuit board, but may alternatively involve the second monopole radiating element being formed on the side of the printed circuit board opposite that on which the first monopole radiating element is formed.

In accordance with a second aspect of the present invention, first and second printed circuit boards are provided with each having a first side and a second side, wherein the second printed circuit board second side is positioned adjacent the first printed circuit board first side. A first monopole radiating element in the form of a conductive trace is formed on the first printed circuit board first side, where the first conductive trace has an electrical length which is resonant within a first specified frequency band. A second monopole radiating element in the form of a second conductive trace is formed on the second printed circuit board first side, where the second conductive trace has an electrical length which is resonant within a second specified frequency band.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 3:
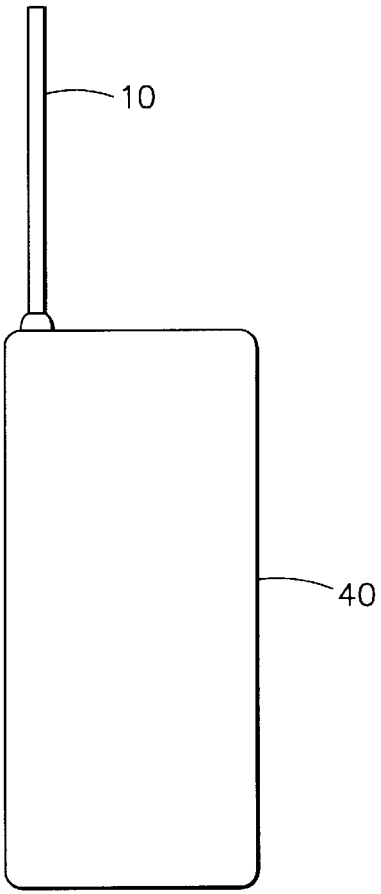
FIG. 3 is a schematic view of the multiple band printed monopole antenna depicted in FIGS. 1 and 2 mounted on a transceiver after it has been overmolded.
Figure 2:
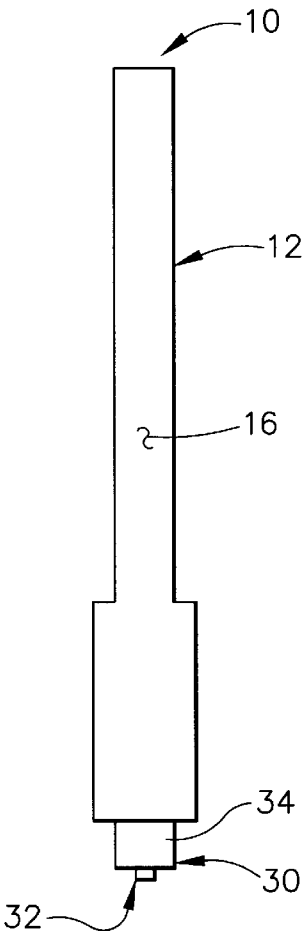
FIG. 2 is a schematic right side view of the multiple band printed monopole antenna depicted in FIG. 1.
Figure 1:
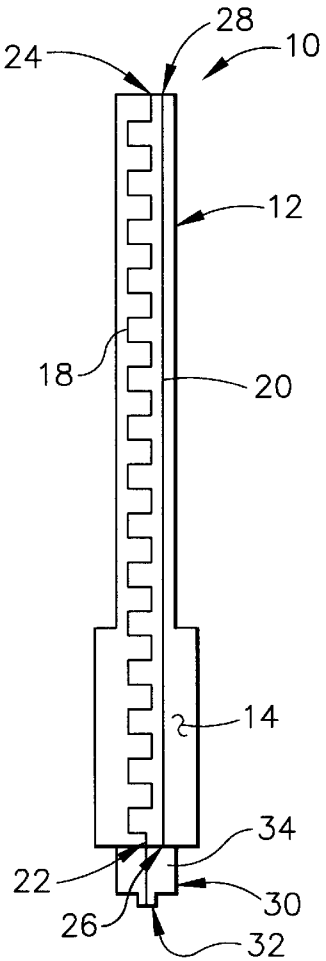
FIG. 1 is a schematic left side view of a multiple band printed monopole antenna in accordance with the present invention.
Figure 5:
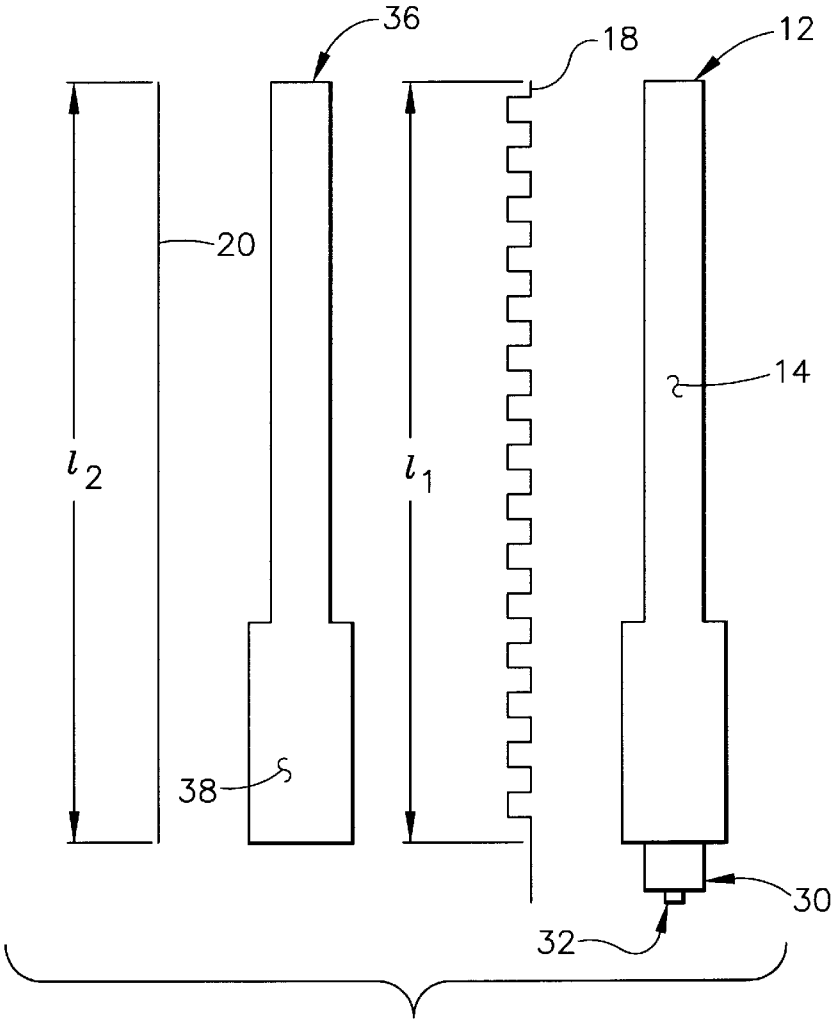
FIG. 5 is an exploded, schematic left side view of a second alternative embodiment for a multiple band printed monopole antenna involving more than one printed circuit board.

Referring now to the drawings in detail, wherein identical numerals indicate the same elements throughout the figures, FIGS. 1–3 depict a printed monopole antenna 10 of the type which can be utilized with radio transceivers, cellular phones, and other personal communication equipment having multiple frequency bands of operation. As seen in FIGS. 1 and 2, printed monopole antenna 10 includes a printed circuit board 12, which preferably is planar in configuration and has a first side 14 (see FIG. 1) and a second side 16 (see FIG. 2). It will be noted that printed monopole antenna 10 includes a first monopole radiating element in the form of a first conductive trace 18 formed on first side 14 of printed circuit board 12. In addition, a second monopole radiating element in the form of a second conductive trace 20 is formed on first side 14 of printed circuit board 12. Alternatively, second conductive trace 20 may be formed on second side 16 of printed circuit board 12.

More specifically, it will be seen that first conductive trace 18 has a physical length $\mathbf{1}_1$ from a feed end 22 to an opposite open end 24. Likewise, second conductive trace 20 has a physical length $\mathbf{1}_2$ from a first end 26 (adjacent to feed end 22 of first conductive trace 18) and a second end 28 (adjacent to open end 24 of first conductive trace 18). As seen in FIG. 1, it is preferred that first and second conductive traces 18 and 20, respectively, be oriented substantially parallel to each other and the respective physical lengths $\mathbf{1}_1$ and $\mathbf{1}_2$ be substantially equivalent.

Figure 4:
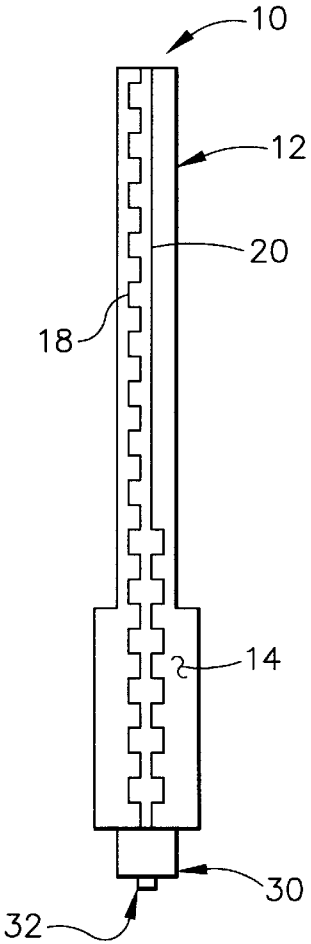
FIG. 4 is a schematic left side view of an alternative embodiment for a multiple band printed monopole antenna in accordance with the present invention.

Due to the non-linear configuration of first conductive trace 18, it will have an electrical length greater than physical length $\mathbf{1}_1$. This type of conductive trace is explained in greater detail in a patent application entitled "Antenna Having Electrical Length Greater Than Its Physical Length," Ser. No. 08/145,959, now abandoned filed concurrently herewith, which is also owned by the assignee of the present invention and hereby incorporated by reference. It will be noted that second conductive trace 20 has a linear configuration so that it has an electrical length substantially equivalent to physical length $\mathbf{1}_2$. Accordingly, it will be understood that first conductive trace 18 has an electrical length greater than that for second conductive trace 20, whereby first conductive trace 18 will be resonant within a lower frequency band than second conductive trace 20. As seen in FIG. 4, second conductive trace 20 may have a non-linear configuration similar to that of first conductive trace 18, wherein second conductive trace 20 would have an electrical length greater than physical length $\mathbf{1}_2$thereof. In either event, it will be recognized that first conductive trace 18 will preferably have an electrical length greater than that of second conductive trace 20.

By differentiating the electrical lengths of first and second conductive traces 18 and 20, respectively, printed monopole antenna 10 will be able to operate within first and second frequency bands. Preferably, the first frequency band will be approximately 800 MegaHertz to approximately 1000 MegaHertz while the second frequency band will be approximately 1800 MegaHertz to approximately 2000 MegaHertz. Alternatively, other frequency bands may be utilized for the second frequency band so that printed monopole antenna 10 can communicate with satellites, such as between approximately 1500 MegaHertz and approximately 1600 MegaHertz or between approximately 2400 MegaHertz and 2500 MegaHertz. In order to better accomplish this multi-band operation, it will be understood that first conductive trace 18 will preferably have an electrical length substantially equivalent to a quarter-wavelength or a half-wavelength of a center frequency within the first frequency band. Correspondingly, second conductive trace 20 will preferably have an electrical length substantially equivalent to a half-wavelength for a center frequency within the second frequency band.

Contrary to prior art antennas, printed monopole antenna 10 requires no direct electrical connection between the first and second monopole radiating elements (first and second conductive traces 18 and 20). Accordingly, second conductive trace 20 will have very little effect on antenna response when first conductive trace 18 is resonant. Moreover, at a higher frequency in which second conductive trace 20 is approximately a half-wavelength thereof, the response of second conductive trace 20 dominates and significant coupling occurs with first conductive trace 18. Since the two responses of first and second conductive traces 18 and 20 are very independent, dual frequency band performance can be obtained by merely adjusting the electrical lengths thereof.

Printed monopole antenna 10 also preferably includes a feed port 30, such as in the form of a coaxial connector, which includes a signal feed portion 32 and a ground portion 34. As best seen in FIG. 1, signal feed portion 32 of feed port 30 is coupled only to first conductive trace 18. By this, it is seen that second conductive trace 20 has no means of receiving a signal other than through the aforementioned coupling with first conductive trace 18. Alternatively, first conductive trace 18 may be coupled to the center conductor of a coaxial connector.

With respect to the construction of printed monopole antenna 10, it is preferred that first printed circuit board 12 be made of a flexible dielectric material, such as polyamide, polyester, or the like. It is also preferred that first conductive trace 18, second conductive trace 20, and first printed circuit board 12 be overmolded with a low-loss dielectric material, as further described in a patent application entitled "Method of Manufacturing a Printed Antenna," Ser. No. 08/460,578, now U.S. Pat. No. 5,709,832 filed concurrently herewith, which is also owned by the assignee of the present invention and hereby incorporated by reference. Printed monopole antenna 10 is schematically depicted in FIG. 3 as being attached in its final form to radio transceiver 40.

An alternative configuration for printed monopole antenna 10 is to include a second printed circuit board 36 positioned adjacent to first printed circuit board 12. Second printed circuit board 36 has a first side 38 and a second side (not seen), wherein second conductive trace 20 is formed on second printed circuit board first side 38 instead of on first printed circuit board first side 14 as shown in FIG. 1. It will be understood that second printed circuit board 36 will be positioned adjacent to but a distance from first printed circuit board 12 so that they lie in planes oriented substantially parallel to each other. The distance between first printed circuit board 12 and second printed circuit board 36 is adjusted to maintain a minimum voltage standing wave ratio at a feed point for printed monopole antenna 10. Consistent with the aforementioned embodiment, second printed circuit board 36 also is preferably made of a flexible dielectric material, with first conductive trace 18, second conductive trace 20, first printed circuit board 12, and second printed circuit board 36 being overmolded.

Having shown and described the preferred embodiment of the present invention, further adaptations of the multiple band printed monopole antenna can be accomplished by appropriate modifications by one of ordinary skill in the art without departing from the scope of the invention. In particular, it will be understood that more than two monopole radiating elements may be utilized with the printed monopole antenna of the present invention, whereby all of such radiating elements may be formed on one side of a single printed circuit board, split between both sides of a single printed circuit board, or allocated between a plurality of printed circuit boards positioned in substantially parallel relationship.

What is claimed is:

1. A printed monopole antenna having a ground plane defined substantially perpendicular thereto and being operable within a first specified frequency band and a second specified frequency band, comprising:

(a) a first printed circuit board having a first side and a second side, said first printed circuit board lying in a plane substantially perpendicular to said ground plane;

(b) a first monopole radiating element comprising a first conductive trace formed on said first printed circuit board first side, said first conductive trace having a physical length from a feed end to an opposite end and a predetermined electrical length so that said first monopole radiating element is resonant within said first specified frequency band;

(c) a feed port including a signal feed portion and a ground portion, said signal feed portion being coupled only to said feed end of said first conductive trace; and (d) a second monopole radiating element positioned adjacent to said first monopole radiating element and not connected to said feed port, said second monopole radiating element comprising a second conductive trace having a physical length from a first end to a second end and a predetermined electrical length so that said second monopole radiating element is resonant within said second specified frequency band, wherein said second conductive trace is electrically coupled to said first conductive trace so as to receive signals through said first conductive trace when said printed monopole antenna is operated within said second specified frequency band.

2. The printed monopole antenna of claim 1, wherein said second conductive trace is formed on said first printed circuit board first side.

3. The printed monopole antenna of claim 2, wherein said first conductive trace, said second conductive trace, and said first printed circuit board are overmolded with a dielectric material.

4. The printed monopole antenna of claim 1, wherein said first and second conductive traces are oriented substantially parallel to each other.

5. The printed monopole antenna of claim 1, wherein the physical lengths of said first and second conductive traces are substantially equivalent.

6. The printed monopole antenna of claim 1, wherein said first frequency band is approximately 800MegaHertz to approximately 1000 MegaHertz.

7. The printed monopole antenna of claim 1, wherein said second frequency band is approximately 1800MegaHertz to approximately 2000 MegaHertz.

8. The printed monopole antenna of claim 1, wherein said first conductive trace has an electrical length greater than said physical length of said first conductive trace.

9. The printed monopole antenna of claim 1, wherein said first conductive trace has an electrical length greater than an electrical length of said second conductive trace.

10. The printed monopole antenna of claim 1, wherein said second conductive trace has an electrical length substantially equivalent to said physical length of said second conductive trace.

11. The printed monopole antenna of claim 1, wherein said second conductive trace has an electrical length greater than said physical length of said second conductive trace.

12. The printed monopole antenna of claim 1, wherein said second conductive trace has an electrical length substantially equivalent to a half wavelength for a frequency within said second frequency band.

13. The printed monopole antenna of claim 1, wherein said first conductive trace has an electrical length substantially equivalent to a quarter wavelength for a frequency within said first frequency band.

14. The printed monopole antenna of claim 1, wherein said first conductive trace has an electrical length substantially equivalent to a half wavelength for a frequency within said first frequency band.

15. The printed monopole antenna of claim 1, wherein no direct electrical connection exists between said first and second monopole radiating elements.

16. The printed monopole antenna of claim 1, wherein said feed port comprises a coaxial connector.

17. The printed monopole antenna of claim 1, wherein said first printed circuit board is made of a flexible dielectric material.

18. The printed monopole antenna of claim 1, wherein said second monopole radiating element is not connected to ground.

19. A printed monopole antenna having a ground plane defined substantially perpendicular thereto and being operable within a first specified frequency band and a second specified frequency band, comprising;

(a) a first printed circuit board having a first side and a second side, said first printed circuit board lying in a plane substantially perpendicular to said ground plane;

(b) a first monopole radiating element comprising a first conductive trace formed on said first printed circuit board first side, said first conductive trace having a physical length from a feed end to an opposite end and a predetermined electrical length so that said first monopole radiating element is resonant within said first specified frequency band;

(c) a feed port including a signal feed portion and a ground portion, said signal feed portion being coupled only to said feed end of said first conductive trace; and (d) a second monopole radiating element positioned adjacent to said first monopole radiating element and not connected to said feed port, said second monopole radiating element comprising a second conductive trace formed on said first printed circuit board second side having a physical length from a first end to a second end and a predetermined electrical length so that said second monopole radiating element is resonant within said second specified frequency band, wherein said second conductive trace is electrically coupled to said first conductive trace so as to receive signals through said first conductive trace when said printed monopole antenna is operated within said second specified frequency band.

20. A printed monopole antenna having a ground plane defined substantially perpendicular thereto and being operable within a first specified frequency band and a second specified frequency band, comprising;

(a) a first printed circuit board having a first side and a second side, said first printed circuit board lying in a plane substantially perpendicular to said ground plane;

(b) a second printed circuit board positioned adjacent to said first printed circuit board, said second printed circuit board having a first side and a second side;

(c) a first monopole radiating element comprising a first conductive trace formed on said first printed circuit board first side, said first conductive trace having a physical length from a feed end to an opposite end and a predetermined electrical length so that said first monopole radiating element is resonant within said first specified frequency band;

(d) a feed port including a signal feed portion and a ground portion, said signal feed portion being coupled only to said feed end of said first conductive trace; and (e) a second monopole radiating element positioned adjacent to said first monopole radiating element and not connected to said feed port, said second monopole radiating element comprising a second conductive trace formed on said second printed circuit board first side having a physical length from a first end to a second end and a predetermined electrical length so that said second monopole radiating element is resonant within said second specified frequency band, wherein said second conductive trace is electrically coupled to said first conductive trace so as to receive signals through said first conductive trace when said printed monopole antenna is operated within said second specified frequency band.

21. The printed monopole antenna of claim 20, wherein said second printed circuit board second side is positioned adjacent said first printed circuit board first side.

22. The printed monopole antenna of claim 20, wherein said first and second printed circuit boards lie in planes oriented substantially parallel to each other.

23. The printed monopole antenna of claim 20, wherein said second printed circuit board is spaced a specified distance from said first printed circuit board to maintain a minimum voltage standing wave ratio at an antenna feed point.

24. The printed monopole antenna of claim 20, wherein said first and second printed circuit boards are made of a flexible dielectric material.

25. The printed monopole antenna of claim 20, wherein said first conductive trace, said second conductive trace, said first printed circuit board, and said second printed circuit board are overmolded.

26. A printed monopole antenna having a ground plane defined substantially perpendicular thereto and being operable within a first specified frequency band and a second specified frequency band, comprising:

(a) a substantially planar printed circuit board having a first side and a second side, said first printed circuit board lying in a plane substantially perpendicular to said ground plane;

(b) a feed port including a signal feed portion and a ground portion;

(c) a first monopole radiating element comprising a first conductive trace formed on said printed circuit board first side, said first conductive trace being coupled to said signal feed portion of said feed port and having an electrical length so as to be resonant within said first specified frequency band; and (d) a second monopole radiating element comprising a second conductive trace formed on said printed circuit board first side adjacent said first conductive trace, said second conductive trace having an electrical length so as to be resonant within said second specified frequency band, wherein said second monopole radiating element is electrically coupled to said first monopole radiating element so as to receive signals through said first monopole radiating element when said printed monopole antenna is operated within said second specified frequency band.

27. The printed monopole antenna of claim 26, wherein said second monopole radiating element is not connected to ground.

28. A printed monopole antenna having a ground plane defined substantially perpendicular thereto and being operable within a first specified frequency band and a second specified frequency band, comprising:

(a) a substantially planar printed circuit board having a first side and a second side, said first printed circuit board lying in a plane substantially perpendicular to said ground plane;

(b) a feed port including a signal feed portion and a ground portion;

(c) a first monopole radiating element comprising a first conductive trace formed on said printed circuit board first side, said first conductive trace being coupled to said signal feed portion of said feed port and having an electrical length so as to be resonant within said first specified frequency band; and (d) a second monopole radiating element comprising a second conductive trace formed on said printed circuit board second side adjacent said first conductive trace, said second conductive trace having an electrical length so as to be resonant within said second specified frequency band, wherein said second monopole radiating element is electrically coupled to said first monopole radiating element so as to receive signals through said first monopole radiating element when said printed monopole antenna is operated within said second specified frequency band.

29. A printed monopole antenna having a ground plane defined substantially perpendicular thereto and being operable within a first specified frequency band and a second specified frequency band, comprising:

(a) a first substantially planar printed circuit board having a first side and a second side, said first printed circuit board lying in a plane substantially perpendicular to said ground plane;

(b) a feed port including a signal feed portion and a ground portion;

(c) a first monopole radiating element comprising a first conductive trace formed on said first printed circuit board first side, said first conductive trace being coupled to said signal feed portion of said feed port and having an electrical length so as to be resonant within said first specified frequency band;

(d) a second substantially planar printed circuit board having a first side and a second side, wherein said second printed circuit board second side is positioned adjacent to and substantially parallel with said first printed circuit board first side; and (e) a second monopole radiating element comprising a second conductive trace formed on said second printed circuit board first side, said second conductive trace having an electrical length so as to be resonant within said second specified frequency band, wherein said second conductive trace is electrically coupled to said first conductive trace so as to receive signals through said first conductive trace when said printed monopole antenna is operated within said second specified frequency band.

30. A printed monopole antenna having a ground plane defined substantially perpendicular thereto and being operable within a plurality of specified frequency bands, comprising:

(a) a substantially planar printed circuit board having a first side and a second side, said first printed circuit board lying in a plane substantially perpendicular to said ground plane;

(b) a feed port including a signal feed portion and a ground portion; and (c) a plurality of monopole radiating elements, each said monopole radiating element comprising a conductive trace formed on one of said printed circuit board sides adjacent each other and having a specified electrical length so as to be resonant within a specified frequency band, wherein only one of said conductive traces is coupled to said signal feed portion of said feed port and the other conductive traces are electrically coupled thereto so as to receive signals through said first conductive trace when said printed monopole antenna is operated within said specified frequency band of resonance therefore.

31. The printed monopole antenna of claim 30, wherein said conductive traces are oriented substantially parallel to each other.

32. The printed monopole antenna of claim 30, wherein said conductive traces have substantially equivalent physical lengths.

33. The printed monopole antenna of claim 30, wherein at least one of said conductive traces has a physical length different than said remaining conductive traces.

34. The printed monopole antenna of claim 30, wherein no direct electrical connection exists between said plurality of monopole radiating elements.

35. The printed monopole antenna of claim 30, wherein said second monopole radiating element is not connected to ground.

36. A printed monopole antenna having a ground plane defined substantially perpendicular thereto and being operable within a plurality of specified frequency bands comprising:

(a) a substantially planar first printed circuit board having a first side and a second side, said first printed circuit board lying in a plane substantially perpendicular to said ground plane;

(b) a substantially planar second printed circuit board having a first side and a second side, said second side of said second printed circuit board being positioned adjacent to and substantially parallel with said first side of said first printed circuit board;

(c) a feed port including a signal feed portion and a ground portion;

(d) at least one monopole radiating element associated with said first printed circuit board, each of said monopole radiating elements comprising a conductive trace formed on said first printed circuit board first side and having a specified electrical length so as to be resonant within one of said specified frequency bands, wherein one of said conductive traces is coupled to said signal feed portion of said feed port and any other conductive traces are electrically coupled thereto so as to receive signals through said fed conductive trace conductive trace having an electrical length so as to be resonant within a; and (e) at least one monopole radiating element associated with said second printed circuit board, each of said monopole radiating elements comprising a conductive trace formed on said second circuit board first side and having a specified electrical length so as to be resonant within one of said specified frequency bands, wherein each conductive trace is electrically coupled to said fed conductive trace on said first printed circuit board so as to receive signals through said fed conductive trace.

37. The printed monopole antenna of claim 36, wherein said conductive traces are oriented substantially parallel to each other.

38. The printed monopole antenna of claim 36, wherein said conductive traces have substantially equivalent physical lengths.

39. The printed monopole antenna of claim 36, wherein at least one of said conductive traces has a physical length different than said remaining conductive traces.

40. The printed monopole antenna of claim 36, wherein no direct electrical connection exists between said plurality of monopole radiating elements.

41. The printed monopole antenna of claim 36, wherein said first and second printed circuit boards lie in planes oriented substantially parallel to each other.

42. The printed monopole antenna of claim 36, wherein said second printed circuit board is spaced a specified distance from said first printed circuit board to maintain a minimum voltage standing wave ratio.

* * * * *